United States Patent [19]

Snedeker

[11] Patent Number: 5,054,125

[45] Date of Patent: Oct. 8, 1991

[54] PROTECTIVE GARMENT WITH LINER INDICATOR

[75] Inventor: Julie A. Snedeker, Northwood, N.H.

[73] Assignee: Globe Manufacturing Company, Pittsfield, N.H.

[21] Appl. No.: 459,345

[22] Filed: Dec. 29, 1989

[51] Int. Cl.[5] ..... A41D 13/00

[52] U.S. Cl. ..... 2/81; 2/93; 2/97; 2/272

[58] Field of Search ..... 2/69, 79, 81, 85, 86, 2/93, 97, 272

[56] References Cited

U.S. PATENT DOCUMENTS

| | | | |
|---|---|---|---|
| 3,805,296 | 4/1974 | Frick | 2/93 |
| 4,103,361 | 8/1978 | Carmen | 2/97 |
| 4,507,806 | 4/1985 | Coombs | 2/85 |
| 4,604,759 | 8/1986 | Bowman | 2/81 |
| 4,768,233 | 9/1988 | Grilliot | 2/81 |
| 4,773,100 | 9/1988 | Kuo | 2/46 |
| 4,774,725 | 10/1988 | Page | 2/81 |
| 4,817,210 | 4/1989 | Aldridge | 2/93 |

*Primary Examiner*—Werner H. Schroeder
*Assistant Examiner*—Diana L. Biefeld
*Attorney, Agent, or Firm*—Watson, Cole, Grindle & Watson

[57] ABSTRACT

A protective garment adapted to be worn by firefighters and the like. The garment is adapted to be worn about the human body and comprises an outer shell and an inner liner adapted to be worn beneath the outer shell, the shell and the liner each comprising a body portion and two appendage portions connected to the body portion. The shell has a lower edge adapted to extend around a portion of the human body and, the liner is of dimensions sufficient to extend below and beneath the edge of the shell such that the extending liner is visible about the entire periphery of the body portion of the garment. The extending and visible liner portion has visually identifying characteristics thereon about its periphery which enable an observer to visually determine whether or not the liner is being worn regardless of the orientation of the observer relative to the wearer of the garment.

9 Claims, 2 Drawing Sheets

PROTECTIVE GARMENT WITH LINER INDICATOR

The present invention relates to a contraction for an articles of apparel and, more particularly, to a contraction for protective garments which are adapted to be worn by firefighters such as, for example, coats, jackets, trousers and the like which have an outer shell and a removable inner liner.

While the present invention will be discussed hereinafter primarily in reference to particular constructions for protective coats and trousers adapted for use by firefighters, it should be recognized and understood that the use and application of the invention is not thereby so limited and that the subject invention may finds utility in other types of garments such as shirts, blouses, vests, overalls and the like which are used in a variety of applications beyond those encountered in firefighting.

In the construction of protective firefighter's coats and trousers as well as other garments, it is the general practice to have the garments comprise an outer shell made of fire-resistant and water-resistant material and a removable inner liner made of heat resistant material adapted to be inserted within the outer shell. While the outer shell and inner liner of the garment could easily be secured together, it is generally more convenient to have the shell and liner separable so that the liner can be easily dried after being subjected to moisture and allow the liner to be washed to so as to remove dirt and grime as well as accumulated perspiration.

A problem oftentimes encountered in the use of such garments having a separable shell and liner is that the firefighter, when called to respond to an emergency situation such as a fire alarm, will only don the outer shell of the protective garment and not the corresponding liner This lapse may be intentional due to the unwillingness of the firefighter to wear the entire garment due to the potential uncomfortable buildup of heat when the liner is worn or due to the liner being wet or damp from previous use or from washing which makes it uncomfortable to wear. On the other hand, the failure to wear the liner may be accidental in that the firefighter, in his haste to respond to the emergency situation, simply forgets to insert the liner into outer shell or he may even be unaware that the liner is necessary for his protection. In either situation, the firefighter is risking his own safety as the garment is not designed to provide complete protection from the hazards encountered in fighting a fire unless the entire garment is worn. As a consequence of the potential failure of a firefighter not wearing the liner with the outer shell, it is generally a employment regulation that the firefighter is to wear both the inner liner and the outer shell of the protective garment in all firefighting situations and it is normally the responsibility of the supervisor of the firefighters to ensure that each firefighter is wearing the complete garment in accordance with regulations.

Since the outer shell of a conventional firefighter's garment obscures the visual observation of the inner liner, it is difficult for a supervisor to easily determine if all the firefighters are properly attired, particularly in the chaos and confusion normally encountered in a firefighting situation. In attempts to alleviate this problem of identifying whether a firefighter is wearing the liner, it has been proposed in U.S. Pat. No. 4,774,725 to Page that the back section of the outer shell of the firefighter's coat include a slit and a strip of reflectorized material attached to outer surface of the shell and that the liner include a flap which can fit through the slit and cover the strip of flourescent and reflective material. In this manner, an observer such as a supervisor can visually determine whether or not the liner is in fact present beneath the outer shell. It has also been proposed in the patent to Coombs, U.S. Pat. No. 4,507,806, that in a protective garment having an outer protective shell, an inner thermal liner and a moisture barrier secured to the outer protective shell proximate to the collar of the garment, the inner thermal liner is provided with a neck and throat protective collar such that when fully assembled, the presence of the neck and throat protective collar serves to visually indicate that the inner thermal liner is in place.

In a somewhat different proposed solution to the same general Problem, U.S. Pat. No. 4,817,210 to Aldridge discloses that a protective coat for firefighters comprises an outer shell, an inner liner and a flap extendable downwardly in a first position below the lower edge of the the back portions of the outer shell and inner liner and foldable upwardly in a second position thereabove. In one embodiment, the coat includes warning indicia attached to the back portion of the outer shell adjacent the lower edge thereof to provide a visual indication that the inner liner is missing when the flap is not in the second position and not in the first position. In a second embodiment, the flap is attached to the lower edge of the outer shell, the flap being extendable downwardly therefrom in a first position and foldable upwardly over the lower edge of the liner in a second position, the coat having warning indicia attached to the flap to provide a visual indication the inner liner may be missing when the flap is in the first position. With either embodiment of the coat, it is the intention that an observer can check with a single glance to quickly and easily determine whether the liner is missing or not without disturbing the firefighter .

However, in all of the above constructions for firefighter's coats, it is not possible for an observer to visually determine whether the liner for the coat is being worn in all situations since, due to the nature of the visual indicator, the firefighter must be in a certain orientation relative to the observer in order for the indicator to be visible. More specifically, in both the coat of the Page patent and the coat of the Aldridge patent, the indicator is located on the back of the coat and thus is only visible to an observer if the firefighter has his back or possibly his side visible to the observer. If the firefighter is facing the observer head on or is somewhat sideways to him, it may not be Possible for the observer to see the indicator or lack thereof and thus determine if the liner was being worn. In a somewhat like manner, the liner indicator of the garment of the Coombs patent would only be visible from the front of the garment.

It is therefore a feature of the present invention to provide a construction for a protective garment such as a firefigher's coat or trousers which enable an observer to visually determine whether a liner is being worn regardless of the orientation of the firefighter relative to the observer.

It is another feature of the present invention to provide a construction for a protective garment such as a firefighter's coat or trousers wherein the visual indicator for whether a liner is being worn is easily recognizable and apparent, especially to other trained firefighters and similar personnel.

It is yet another feature of the present invention to provide a construction for a protective garment such as a firefighter's coat or trousers which includes a visual indicator for whether the liner therefore is being worn which is relative easy and economical to manufacture.

SUMMARY OF THE INVENTION

Briefly, the present invention comprehends a garment adapted to be worn about the human body comprising a outer shell and a liner adapted to be worn beneath the outer shell, the shell and the liner each comprising a body portion and two appendage portions connected to the body portion, the shell having a lower edge adapted to extend around a portion of the human body, the liner being of dimensions sufficient to extend below and beneath the edge of the shell such that the extending liner is visible about the entire periphery of the body portion of the garment, the extending and visible liner portion having visually identifying characteristics thereon about its periphery.

The subject invention further comprehends a garment adapted to be worn about the upper torso of the human body, the garment including a outer shell and an inner liner adapted to be worn beneath the outer shell, the shell and the liner each comprising a body portion and two arm portions connected to the body portion, the shell having a lower edge adapted to extend around a portion of the human body, the liner being of dimensions sufficient to extend below and beneath the edge of the shell such that the extending liner is visible about the entire periphery of the body portion of the garment, the extending and visible liner portion having a visually identifying characteristic thereon about its periphery.

The subject invention also comprehends a garment adapted to be worn about the lower portion of the human body including the lower torso region and the legs, the garment comprising a outer shell and an inner liner adapted to be worn beneath the outer shell, the shell and the liner each comprising a body portion and two leg portions connected to the body portion, the shell having a lower edge adapted to extend around a portion of the human body, the liner being of dimensions sufficient to extend below and beneath the edge of the shell such that the extending liner is visible about the entire periphery of at least one leg portion of the garment, the extending and visible liner portion having visually identifying characteristics thereon about its periphery.

Further features, objects and advantages of the present invention will become more fully apparent from a detailed consideration of the arrangement and construction of the constituent parts as set forth in the following description taken together with the accompanying drawings.

DETAILED DESCRIPTION OF THE PREFERRED EMBODIMENTS

Figure 1:
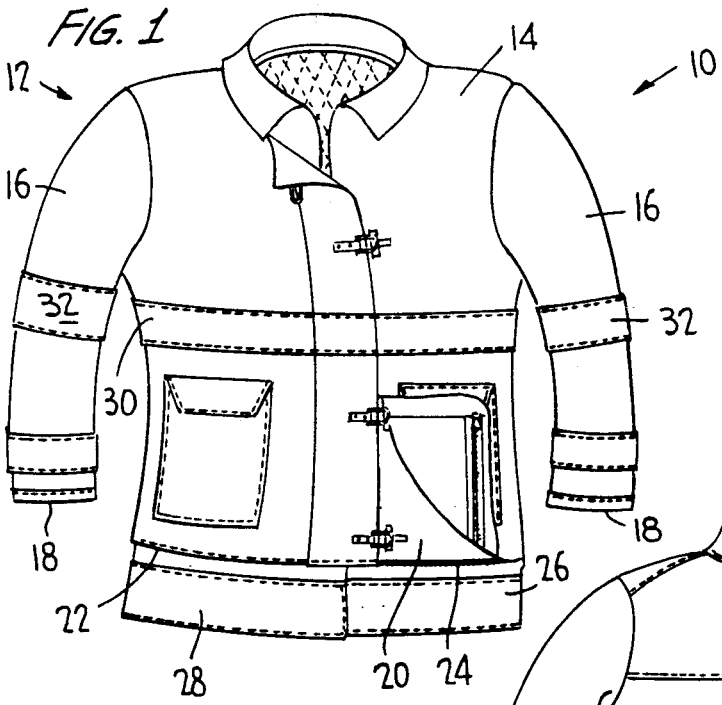
FIG. 1 is a front view of a firefighter's protective coat or jacket having a construction in accordance with the present invention.
Figure 2:
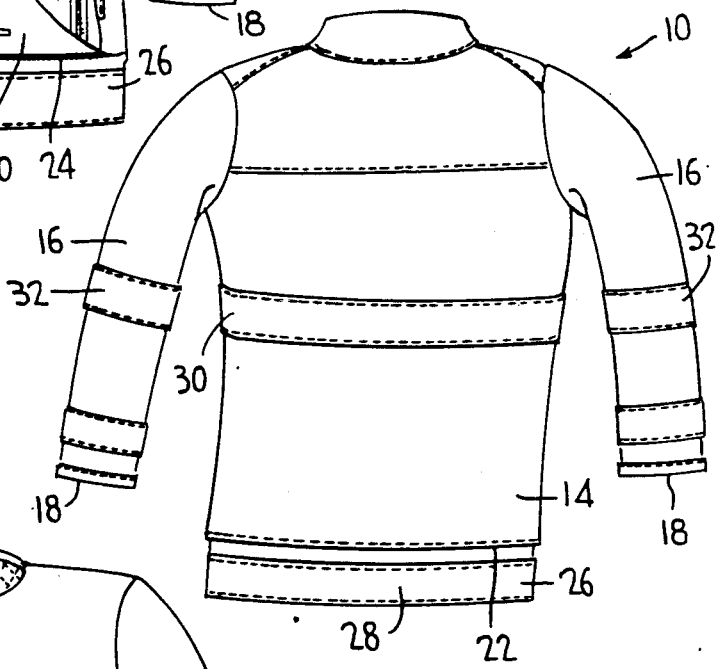
FIG. 2 is a back view of the firefighter's coat or jacket shown in FIG. 1.

Referring first to FIGS. 1 and 2, shown are front and back views of firefighter's coat 10 having a construction according to the present invention. Coat 10 in this illustrative embodiment includes outer shell 12 of a fabric adapted to resist flame and heat as well as repel water and water vapor so as to keep the firefighter dry. As is generally conventional, outer shell 12 of coat 10 includes body portion 14 adapted to be about the torso of a wearer and two sleeves 16 adapted to be about the wearer's arms. Sleeves 16 terminate in cuffs 18 having a layer of wear-resistant material such as leather thereover. Suitable materials for the shell 12 of coat 10 include an aramid fabric sold under the tradename "Nomex" by E.I. duPont de Nemours & Co., Wilmington, Delaware, U.S.A., which has been treated or coated with a water repellant finish such as neoprene to provide water-resistance.

Figure 3:
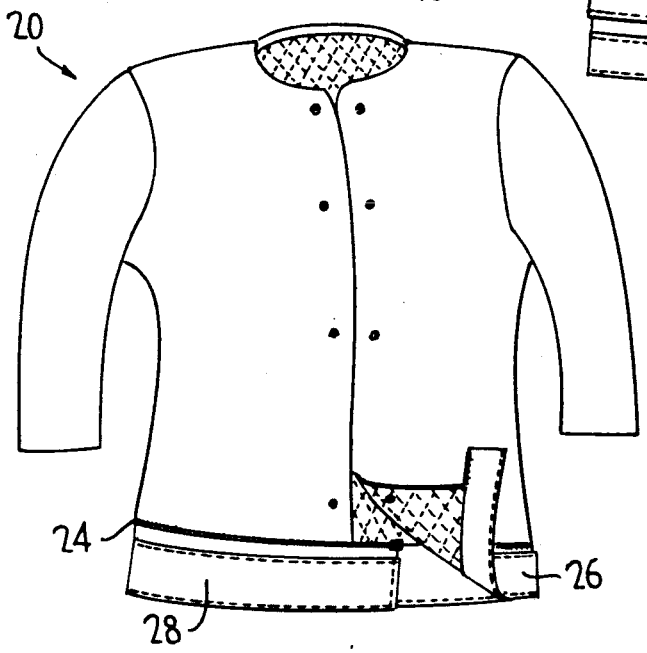
FIG. 3 is a front view of the inner liner of the coat of FIG. 1.

Coat 10 also includes a removable inner liner 20 beneath outer shell 12 which, like the outer shell, comprises a body portion about the upper torso of a wearer and two attached arm portions. In FIG. 1, a portion of outer shell 12 is shown folded upwardly to illustrate part of liner 20. The front of liner 20 is also shown in FIG. 3. Preferably, inner liner 20 is made of an inner layer of heat-insulating or heat resistant material, such as a woven fabric or quilt made of nylon-polyester or "Nomex" aramid fibers, and an outer layer which functions as vapor barrier such as a neoprene coated cotton/polyester or "Nomex" aramid or a layer of polymeric material sold under the tradename "Goretex" by the W.L. Gore Company. Coats 10 of this type in terms of materials of construction and fabrication for outer shell 12 and inner liner 20 are described in U.S. Pat. No. 4,604,759 to Bowman et al and the previously mentioned patent to Page, both incorporated by their reference herein in their entirety.

In accordance with the present invention, inner liner 20 of coat 10 extends below the entire lower peripheral edge or hem 22 of outer shell 12 such that the lower portion 26 of the inner liner is clearly visible from the exterior of coat 10 regardless of the position of a viewer or observer relative to the coat. Preferably, the lower peripheral edge or hem 22 of the outer shell 12 is releasably secured to the exterior of liner 20 by suitable fastening means 24 such as a slide fastener as is shown in FIGS. 1 and 3 or by other releasable fastening means such as snaps, buttons, hook and loop type fasteners sold under the tradename "Velcro" and the like. Generally such fastening means 24 extends about entire lower hem 22 of outer shell 12 and about the body or torso portion of the liner 20.

Also in accordance with the present invention, portion 26 of inner liner 20 extending below edge 22 of outer shell 12 is provided with some type of easily recognizable identifying characteristic such as indicia or contrasting color relative to the outer shell such that an observer can easily visually determine whether the liner is being worn beneath the shell. While this identifying characteristic can take innumerable forms, it is presently preferred that lower exposed portion 26 of inner liner 20 be provided with fluorescent and light-reflective horizontal and continuous bands 28, such as green, orange or yellow "Reflexite" material sold by the Reflexite Corporation, New Britain, Conn., U.S.A., about at least a portion, preferably all the liner that extends beneath edge or hem 22 of outer shell 12. The color of such band 28 should preferably be selected so as to distinctly contrast visually with the dominant color of outer shell 12.

While not all of inner liner 20 extending beneath the edge or hem needs to have identifying characteristics which are clearly visible to an observer, the periphery of the extending liner should include sufficient identifying characteristics such that an observer can easily determine whether the liner is being worn from any observation angle relative to the coat 10. Thus the identifying characteristics can be continuous such as a band or line or discontinuous such as various indicia like letters, numbers, symbols and the like or combinations thereof. If indicia are used, sufficient number of indicia should be included about the lower peripheral portion 26 of liner 20 to facilitate easy visual observation from all angles. The presently preferred continuous bands 28 of reflective and fluorescent material may be secured to liner 20 by suitable means such as stitching and the like.

An important advantage of using the preferred continuous bands of reflective and fluorescent material as the identifying characteristic is that such bands are required on a garment in order that the garment will conform with the 1971 voluntary standards of the National Fire Protection Association. Such regulations also require band 30 extending about the upper torso portion of the coat and parallel bands 32 about the upper arm portion as is shown in FIGS. 1 and 2. Since such regulations are widely followed in the firefighting industry, a particular advantage is realized in using a band as the identifying characteristic for the liner since the bands are easily recognizable and familiar to the average firefighter. Consequently, the lack of such a band when the liner is not being worn beneath the outer shell would be immediately and readily noticable to to the trained and educated observer.

Figure 4:
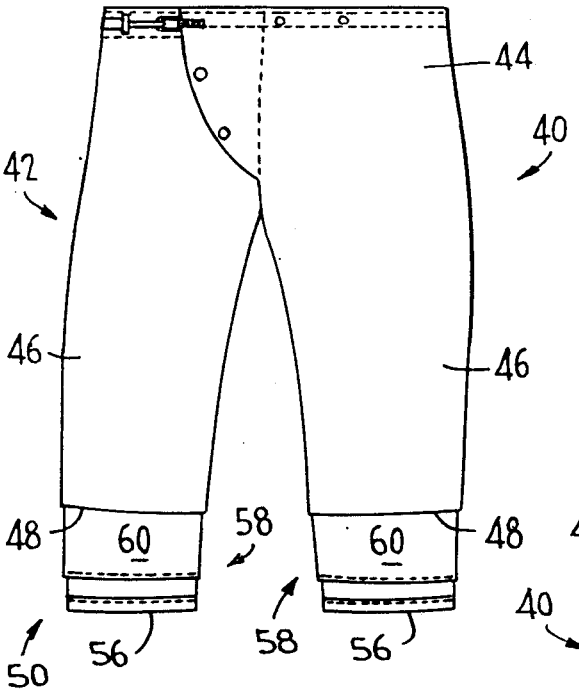
FIG. 4 is a front view a firefighter's protective trousers having a construction in accordance with the present invention.

Turning now to FIG. 4, shown is the front of firefighter's trousers 40 having a construction according to the present invention. Trousers 40 in this illustrative embodiment, like coat 10, include outer shell 42 of a fabric adapted to resist flame and heat as well as repel water and water vapor so as to keep the firefighter dry. As is generally conventional, outer shell 42 of trousers 40 includes body encircling portion 44 adapted to be about the lower torso of a wearer and two tubular portions 46 adapted to be about the wearer's legs. Suitable materials for outer shell 42 of trousers 40 include those mentioned above with reference to the materials for outer shell 12 of coat 10.

Figure 6:
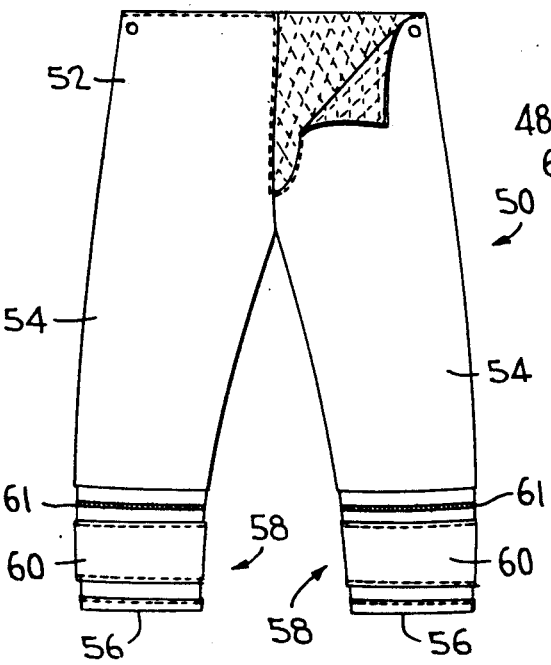
FIG. 6 is a front view of the inner liner of the trousers of FIG. 4.

Trousers 40 also include removable liner 50 beneath outer shell 42 which, like the outer shell, comprises portion 52 about the torso of a wearer and two attached leg portions 54 as shown in FIG. 6. Leg portions 54 of liner 50 extend below and beyond lower edge or hem 48 of the leg portion of outer shell 42 and terminate in cuffs 56 having a layer of wear-resistant material such as leather thereover. Liner 50 may be made of an inner layer of heat-insulating or heat resistant material and an outer layer of a material forming a vapor barrier such as those mentioned above with reference to the materials for inner liner 20 of coat 10.

Figure 5:
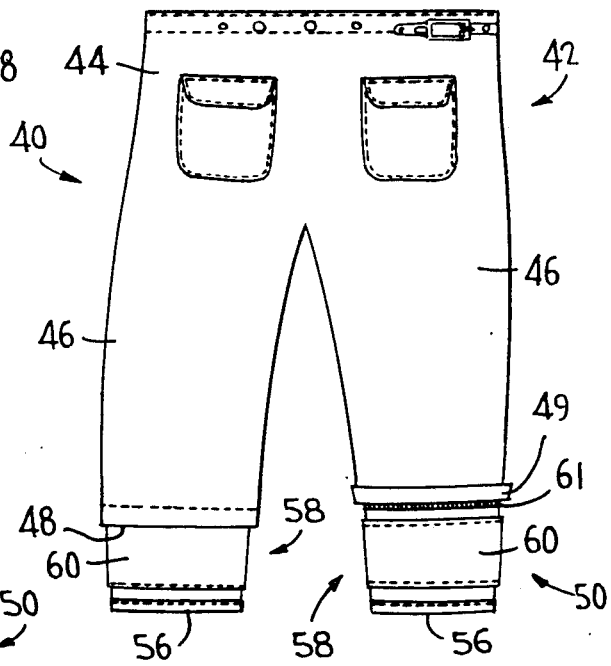
FIG. 5 is a back view of the firefighter's trousers shown in FIG. 4.

In accordance with the present invention, inner liner 50 of trousers 40 extends below the entire lower hem 48 of outer shell 42 such that lower or distal portion 58 of the liner is clearly visible from the exterior of trousers 40 regardless of the position of a viewer or observer relative to the trousers. Preferably, the lower edge 48 of the outer shell 42 is releasably secured to the exterior of inner liner 50 by suitable fastening mean 61 such as a slide fastener as is shown in FIGS. 5 and 6 or by other releasable fastening means such as snaps, buttons, hook and loop type fasteners sold under the tradename "Velcro" and the like. It should be noted that in FIG. 5, protective flap 49 over one fastening means 61 has been folded upwardly for clarity to show the fastening means. Generally such fastening means 61 extends about the entire lower peripheral edge or hem 48 of outer shell 42.

Also in accordance with the present invention, the portion 58 of inner liner 50 extending below edge 48 of outer shell 42 is provided with some type of easily recogizable identifying characteristic such as indicia or contrasting color relative to the outer shell such that an observer can easily visually determine whether inner liner 50 is being worn beneath the shell. While this identifying characteristic can take innumerable forms as was mentioned above with reference to liner 20 of coat 10, it is presently preferred that lower portion 58 of liner 50 be provided with fluorescent and light-reflective horizontal bands 46, such as green, orange or yellow "Reflexite" material, about at least a portion, preferably all the liner that extends beneath edge 48 of outer shell 42. While not all of portion 58 of inner liner 50 extending beneath edge 48 needs to be clearly visible to an observer, the entire periphery of the extending liner portion should include sufficient identifying characteristics such that an observer can determine whether the liner is being worn from any observation angle relative to trousers 40. The preferred bands 60 of such reflective and fluorescent material may be secured to liner 50 by suitable means such as stitching and the like.

An important advantage of using bands 60 of reflective and fluorescent material as the identifying characteristic for trousers 40 is that such bands are required for the trousers to conform with the 1971 voluntary standards of the National Fire Protection Association as was discussed above with reference to coat 10. Consequently, the lack of such a band when liner 50 is not worn beneath outer shell 42 of trousers 40 would be immediately and readily noticable to to the trained and educated observer.

While there has been shown and described what is considered to be preferred embodiments of the present invention, it will be apparent to those skilled in the art to which the invention pertains that various changes and modifications may be made therein without departing from the invention as defined in the appended claims.

It is claimed:

1. A garment adapted to be worn about the upper torso of a human boxy, the garment including an outer shell and a liner adapted to be worn within the outer shell, the shell and the liner each comprising a body portion and two arm portions connected to the body portion, the shell having a lower portion defining a lower edge adapted to extend around a portion of a human body, the body portion of the liner having dimensions sufficient to extend below and beneath the lower edge of the body portion o the shell to provide an extending portion having an outer surface which is visible about the entire periphery of the body portion of the garment, the outer surface of the extending and visible liner portion o the body portion of said liner having a band of reflective material thereon about its entire extending periphery.

2. A garment according to claim 1 wherein said reflective material is also fluorescent.

3. A garment according to claim 1 wherein the outer shell is a fire and flame resistant material and the inner liner comprises an inner and outer layers, the inner layer being of heat insulating material and the outer layer of material which acts as a vapor barrier.

4. A garment according to claims 3 wherein the outer shell is of a fire and flame resistant fabric material and the inner layer of the liner is of quilted fabric material.

5. A garment according to claim 3 wherein the inner layer and outer layer of the liner are secured together.

6. A garment according to claim 1 wherein the lower portion of the outer shell is releasably secured to the liner by fastening means.

7. A garment according to claim 6 wherein the fastening means includes a slide fastener.

8. A garment according to claim 5 wherein said reflective material is also fluorescent.

9. A garment adapted to be worn about the upper torso of a human body, the garment including an outer shell and a liner adapted to be worn within the outer shell, the shell and the liner each comprising a body portion and two arm portions connected to the body portion, the shell having a lower portion defining a lower edge adapted to extend around a portion of a human body, the body portion of the liner having dimensions sufficient to extend below and beneath the lower edge of the body portion of the shell to provide an extending portion having an outer surface which is visible about the entire periphery of the body portion of the garment, the outer surface of the extending portion o the body portion of said liner having a band of fluorescent material thereon about its entire extending periphery.

* * * * *